United States Patent [19]

Chi

[11] 4,158,421

[45] Jun. 19, 1979

[54] FOLDABLE PACKING CASE

[76] Inventor: Hsu T. Chi, No. 496-2, Fu Ching St., Taipei, Taiwan

[21] Appl. No.: 873,641

[22] Filed: Jan. 30, 1978

[51] Int. Cl.[2] ..... B65D 7/26; B65D 9/14

[52] U.S. Cl. ..... 220/6; 217/14; 217/16; 217/48; 217/59; 217/65; 220/7; 220/331

[58] Field of Search ..... 220/6.7, 331; 217/14, 217/16, 46, 48, 59, 65

[56] References Cited

U.S. PATENT DOCUMENTS

| | | | |
|---|---|---|---|
| 277,061 | 5/1883 | Rohe | 217/59 |
| 916,848 | 3/1909 | Cox | 217/48 |
| 1,147,613 | 7/1915 | Day | 217/14 |
| 1,222,832 | 4/1917 | Wilhelim | 217/59 |
| 1,286,572 | 12/1918 | Fisher | 217/46 |
| 3,752,349 | 8/1973 | Rana | 217/14 |

FOREIGN PATENT DOCUMENTS

| | | | |
|---|---|---|---|
| 893564 | 2/1972 | Canada | 220/6 |

*Primary Examiner*—George E. Lowrance
*Attorney, Agent, or Firm*—Ladas, Parry, Von Gehr, Goldsmith & Deschamps

[57] ABSTRACT

A packing case molded from plastic materials comprises two side walls including two half-walls rotatably connected to each other by tenon/mortise joint and hinge elements, two end walls rotatably connected to the adjacent side walls by tenon/mortise joint and hinge elements, and two cover plates removeably intersecting with said connected walls, thereby to form a foldable container which can easily pack or unpack without need of any external means, and can be folded into a collapsed form that is easily recovered for further use.

7 Claims, 9 Drawing Figures

FOLDABLE PACKING CASE

BACKGROUND OF THE INVENTION

1. Field of the Invention

The present invention relates to a novel packing case constructed in a foldable structure that can easily pack and unpack the goods contained therein without need of any external means and which may be conveniently recovered from a folded form for further use repeatedly.

2. DESCRIPTION OF THE PRIOR ART

Most used conventional packing cases are cartons, wooden cases or the like. The known cartons are breakable, subject to abrasion caused by wearing or wetting, and usually can not be used more than once, thus not suitable for repeated use. The known wooden cases, which are heavy in weight, bulky in volumn, not conveniently in transportation, usually pack and unpack a content therein in a cumbersome manner as additional external means is needed, and which is not fordable and not easily recovered for repeated use. In addition, known packing cases maybe result in more garbage-dispose and surrounding-pollution problems.

SUMMARY OF THE INVENTION

The most import object of the invention is to provide a novel packing case which overcomes all the above disadvantages with conventional packing cases.

A second object of the invention is to provide a packing case which can easily pack or unpack the content therein without need of any external means or attachments such as ropes, tapes.

The third object of the invention is to provide a packing case which is foldable and can be easily recovered for repeated use.

These and other objects and advantages of the present invention will be become more apparent from the following detailed description of a preferred embodiment with reference to accompanying drawings, wherein.

DESCRIPTION OF A PREFERRED EMBODIMENT

Figure 1:
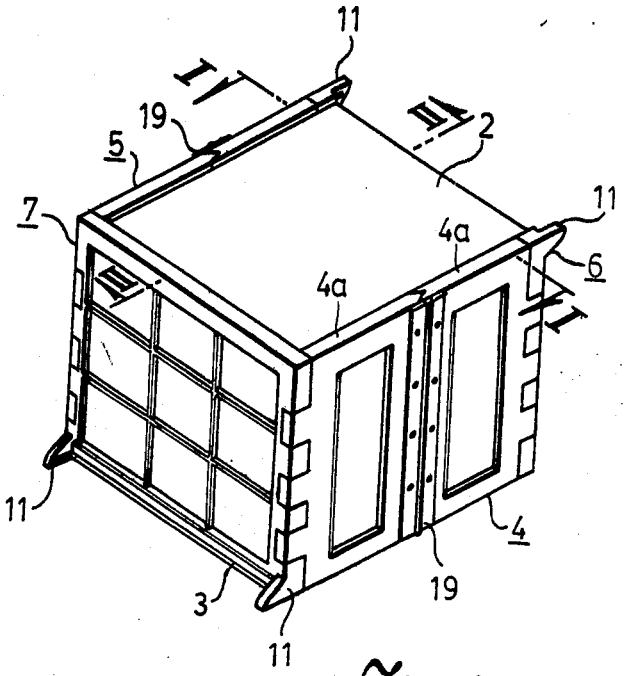
FIG. 1 is a perspective view showing a packing case according to the present invention.
Figure 4:
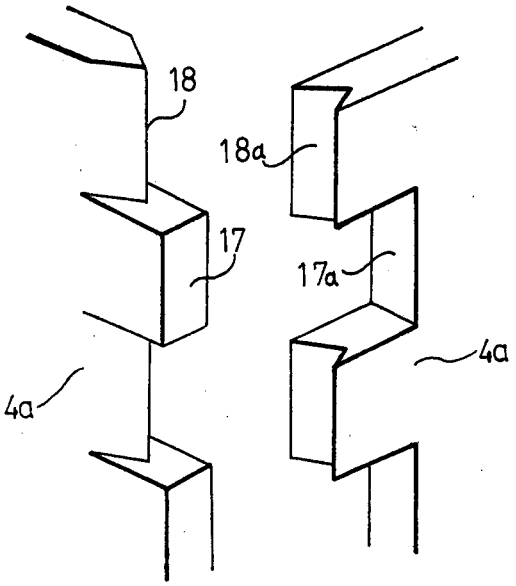
FIG. 4 is a perspective view illustrating a tenon/mortise joint between two half-walls according to the present invention.

Referring to FIG. 1, a packing case according to the present invention as shown comprises two side walls 4, 5, two end walls 6, 7 and two cover plates 2, 3. Each of said side walls, for istance, the side wall 4 comprises two half-walls 4*a* which are rotatably connected to each other by tenons 17, 18 and mortises 17*a*, 18*a* integrally formed on adjacent longnitudinal edges thereof (FIG. 4) and hinge elements 19, whereby the side walls become foldable along the longnitudinal axis of said hinge element.

Figure 5:
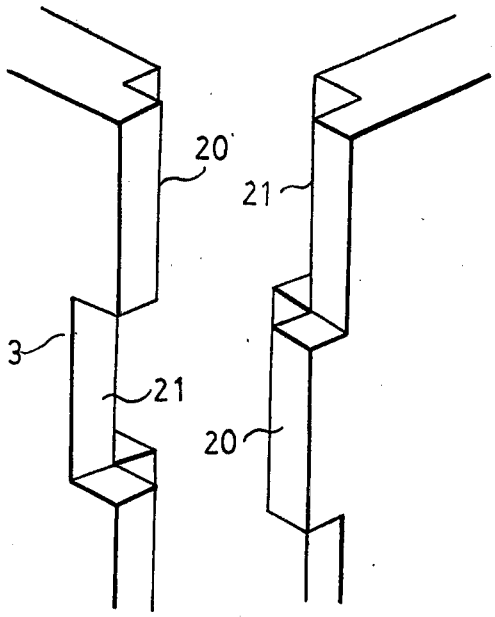
FIG. 5 is a perspective view illustrating a tenon/mortise joint between adjacent end and side walls according to the present invention.
Figure 7:
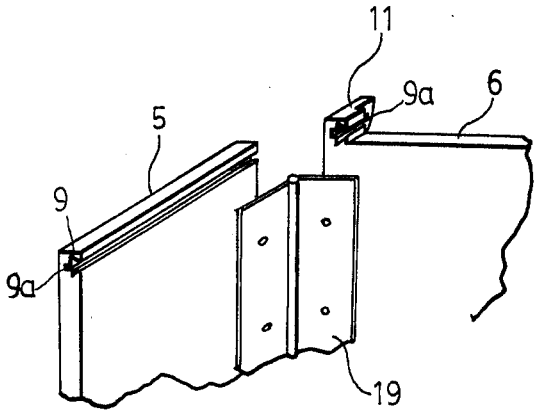
FIG. 7 is an exploded, fragmentary view showing a flute 9 and a retaining portion 11 of a packing case according to the present invention.
Figure 8:
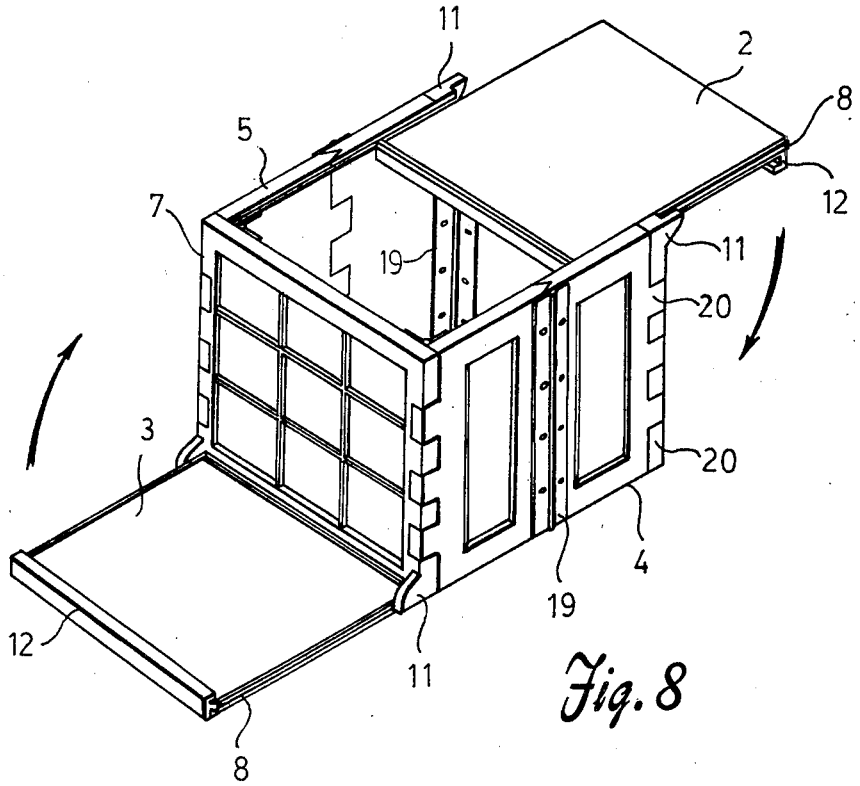
FIG. 8 is a perspective view illustrating the way to open said cover plates of the packing case shown in FIG. 1.

Furthermore, the side walls 4, 5 are rotatably connected to adjacent end walls 6, 7 at essentially right angle by hinge element 19 and tenon 20/mortise 21 joint, which are best shown in FIGS. 5, 7 and 8. Said tenons 20/mortises 21 are alternatively, integrally constructed longnitudinal edges of said walls in a suitable form that the adjacetn longnitudinal edges can effect a tenon/mortise joint at essentially right angle. It will be described further hereinbelow how the tenon 20/mortise 21 joint as well as tenons 17, 18, mortises 17*a*, 18*a* will cooperate with corresponding hinge elements 19 to make said walls foldable.

Figure 2:
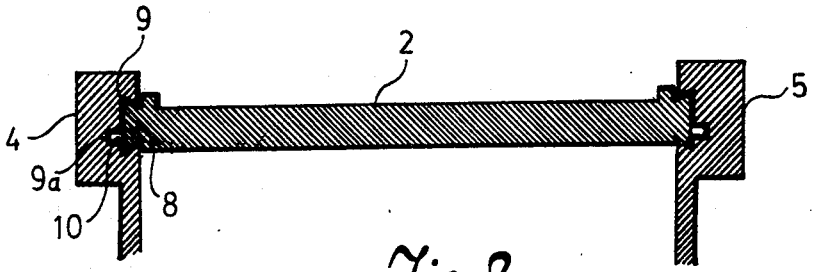
FIG. 2 is a partially sectional view taken along line I—I in FIG. 1.
Figure 3:
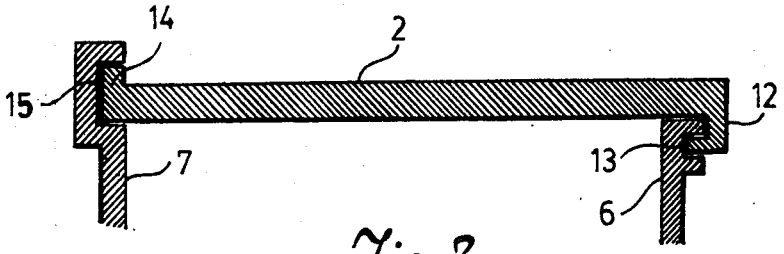
FIG. 3 is a partially sectional view taken along line II—II in FIG. 2.

Referring now to FIGS. 2, 3 and 7, each of said half-walls has two flutes 9 seperately countersunk on inside-face and along transverse edges thereof, and the adjacent flutes may axially engage and communicate with each other while the corresponding half-walls being engaged with each other to form a planar side wall. Each of the end walls 6, 7 has two retaining portions 11 which are seperately formed on ends of a transverse edge there of and which has a flute having a first part similar to and axially engageable with the adjacent flute 9 as well as a narrow thiner part 9*a* which is extended from the deepest portion of the first part and terminates in a close end. The first end wall 6 is assembled in the packing case with the transverse edge having said retaining portions thereof up, and the second end wall 7 is assembled in the packing case with the transverse edge having said retaining portions thereof down, and in opposite position with respect to said first end wall.

Figure 6:
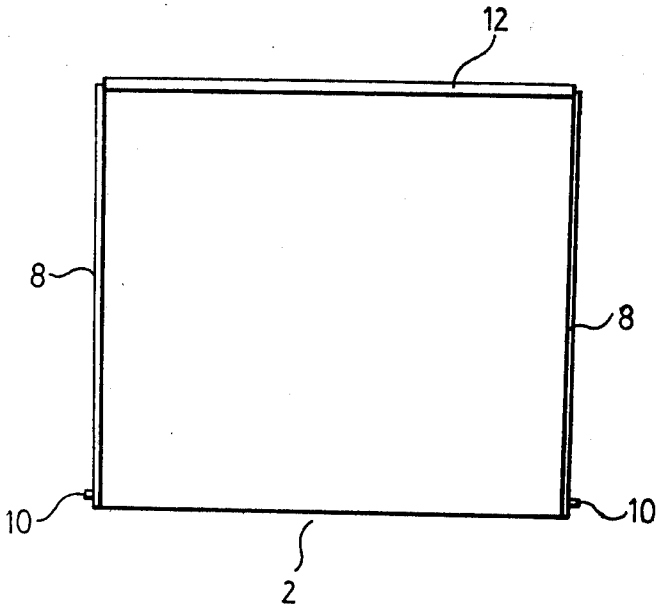
FIG. 6 is a top view showing a cover plate according to the present invention.

Said cover plates 2, 3 have identical structure and both removeably intersect with adjacent transverse edges of said end and side walls in a similar manner. For instanct, the top cover plate 2 as illustrated in FIG. 6 has a first pair of opposite edges thereof formed as flanges 8 having inner ends thereof individually provided with a stop protrusion 10, which may fit and slid in a space defined by said flutes 9 and the adjacent flute of said retaining portions 11, while said side walls are in planar station and engage with adjacent end walls at right angle.

When the cover plate 2 is pushed inward to a place interlocking with top edges of said walls, as shown in FIG. 1, said planges 8 and stops protrusions 10 are engaged in said flutes 9 (FIG. 2), and the inner edge 14, the outter hook-edge 12 thereof are respectivelly engaged in grooves 15 and 13, as shown in FIG. 3. The bottom cover plate 3 removeably interlocks with bottom edges of said walls in a same manner as describered hereinabove, thereby said walls cooperate with said cover plates to form a rigid container suitable for packing therein goods or the like.

It should be noted that said packing case may be provided with a suitable means such as a lock set to lock said cover plates 2, 3 in closed state from being undesirably open.

The closed case can easily open by pulling outward one of said cover plates to effect a unpacking process. As shown in FIG. 8, the cover plates 2, 3 are both being pulled outward and when to a maximum extent, said stop protrusions 10 (not seen) will be retained in the narrow thiner parts 9a of the flute in said retaining portions, thereby said cover plates can be pivoted 90 degree in the direction the arrows show to rest against adjacent outter faces of said end walls 6, 7.

Figure 9:
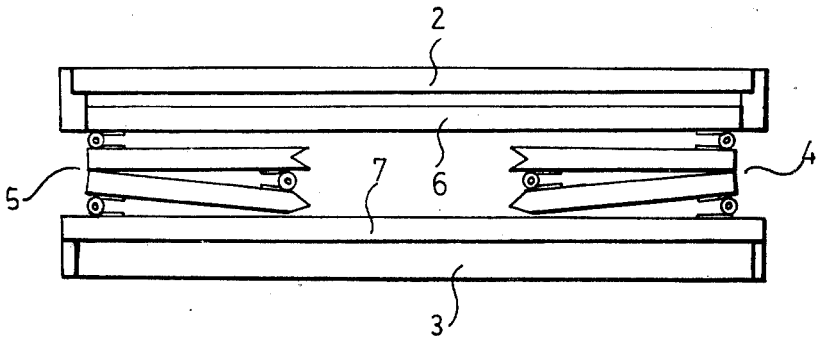
FIG. 9 is a top view showing a folded packing case according to the present invention.

Subsequently, the open, empty packing case can be folded inward to a collapsed form, as shown in FIG. 9, which occupies the least volumn and can be easily recovered to pack goods repeatedly.

It should be noted that said tenon/mortise portions may be shaped in other suitable forms that can effect tenon/mortise joint between the adjacent walls or half-walls and can cooperate with the hinge elements to rotatably connect said walls in a foldable manner. Said flanges may be formed in other suitable forms, e.g., T-shaped flanges, of course, the corresponding flute 9 and retaining flute 11 should be modified accordingly. The walls and cover plates comprised in a packing case according to the invention may be molded in form from plastic materials which prefer to be a polypropylens material.

What I claim is:

1. A packing case comprising two side walls, two end walls and two cover plates, each of said walls and each of said cover plates being of rectangular shape having two pairs of opposed parallel edges arranged perpendicular to each other, and the packing case also comprising tenon/mortise joint means and hinge means rotatably connecting one pair of edges of each side wall to respective edges of the end walls respectively, and each side wall including two rectangular half-walls each having two pairs of opposed parallel edges arranged perpendicular to each other with said one pair of edges of each side wall being formed by one edge of each of said two half-walls, and each side wall further including tenon/-mortise joint means and hinge means rotatably connecting the edges of said two half-walls which are opposed and parallel to said one edges thereof, and each side wall being formed along the edges of its other pair of edges with respective longitudinal grooves in which respective edges of the cover plates are slidingly fitted, whereby upon sliding the cover plates along the grooves towards closed position the cover plates retain the half-walls of each side wall in substantially coplanar relation and retain the end walls at right angles to the side walls whereas upon sliding the cover plates along the grooves towards open position and removing the cover plates from the grooves the half-walls of each side wall can be collapsed into mutually confronting relationship.

2. A packing case as claimed in claim 1, wherein each end wall is formed with two retaining portions at opposite ends respectively of one edge of the end wall other than the edges thereof which are connected to the side walls, said one edges of the end walls being diagonally disposed with respect to said side walls, and wherein each retaining portion is formed with a groove which constitutes a continuation of the longitudinal groove in the edge of the side wall adjacent thereto, each longitudinal groove and and the continuation thereof having a base in which is formed a narrow channel which terminates in the retaining portion, and each cover plate being provided with projections fitted in the channels of the grooves in which the edges of the cover plate are fitted, whereby upon sliding the cover plates along the grooves towards open position the projections are retained in the respective narrow channels and the cover plates can be pivoted about the projections into confronting relationship with the end walls while the projections are so retained.

3. A packing case as claimed in claim 1, wherein each end wall is formed along one edge thereof, other than the edges connected to the side walls, with a slot in which an edge of one of the cover plates, other than the edges fitted in said longitudinal grooves, is received when the cover plate is in closed position, and the cover plate is formed along its fourth edge with a hook formation which engages about the fourth edge of the other end wall.

4. A packing case as claimed in claim 1, wherein the edges of the half-wall which are connected together are formed integrally with tenon and mortise structures to provide said tenon/mortise joint means of said side walls.

5. A packing case as claimed in claim 1, wherein said side walls and said end walls are formed integrally at the edges which are connected together with tenon and mortise structures to provide the tenon/mortise joint means connecting the side walls and the end walls.

6. A packing case as claimed in claim 1, wherein the side walls, the end walls and the cover plates are molded from plastics material.

7. A packing case as claimed in claim 6, wherein said plastics material comprises polypropylene.

* * * * *